US007852307B2

(12) United States Patent
Hudson

(10) Patent No.: US 7,852,307 B2
(45) Date of Patent: Dec. 14, 2010

(54) MULTI-MODE PULSE WIDTH MODULATED DISPLAYS

(75) Inventor: Edwin Lyle Hudson, Los Gatos, CA (US)

(73) Assignee: Jasper Display Corp., Hsinchu (TW)

( * ) Notice: Subject to any disclaimer, the term of this patent is extended or adjusted under 35 U.S.C. 154(b) by 851 days.

(21) Appl. No.: 11/740,244

(22) Filed: Apr. 25, 2007

(65) Prior Publication Data

US 2007/0252855 A1 Nov. 1, 2007

Related U.S. Application Data

(60) Provisional application No. 60/745,875, filed on Apr. 28, 2006.

(51) Int. Cl.
*G09G 3/36* (2006.01)

(52) U.S. Cl. ..... 345/99; 345/691

(58) Field of Classification Search ..... 345/87–101, 345/204–215, 690–699
See application file for complete search history.

(56) References Cited

U.S. PATENT DOCUMENTS 6,369,782 B2 * 4/2002 Shigeta ..... 345/63
6,587,084 B1 7/2003 Alymov et al.
6,784,898 B2 * 8/2004 Lee et al. ..... 345/692
2002/0140662 A1 10/2002 Igarashi
2005/0001806 A1 1/2005 Ohmura
2005/0088462 A1 * 4/2005 Borel ..... 345/691
2005/0195894 A1 9/2005 Kim et al.
2006/0012589 A1 1/2006 Hsieh et al.
2007/0252856 A1 11/2007 Hudson et al. ..... 345/693

OTHER PUBLICATIONS

International Search Report and The Written Opinion of the International Search Authority issued in PCT/US07/67511 on Feb. 20, 2008.
Kang et al., "Digital Driving of TN-LC for WUXGA LCOS Panel," Digest of Technical Papers, Society for Information Display, 2001, pp. 1264-1267.

* cited by examiner

*Primary Examiner*—Vijay Shankar
(74) *Attorney, Agent, or Firm*—Kusner & Jaffe

(57) ABSTRACT

Methods, apparatus, and pulse width modulating a display include receiving image data and generating pulse data to be written to rows of pixels in a display. The data include a pulse width modulated drive sequence that writes data to selected rows on a first phase of a clock and terminates a write operation on a different row on a second phase of the clock.

25 Claims, 13 Drawing Sheets

202 204

| | | DATA | CLOCK | | | |
|---|---|---|---|---|---|---|
| Data Row | 1 | 00010000 00000000 | 1 | ; | ts1 | Load address 0 |
| Data Row | 2 | 00000000 00000000 | 0 | ; | ts1 | Load address 0 |
| Data Row | 3 | 00000000 00000000 | 1 | ; | ts1 | column = 0 |
| Data Row | 4 | 11111111 11111111 | 0 | ; | ts1 | column = 0 |

FIG. 2A 202 204

| | D15 | D14 | D13 | D12 | D11 | D10 | D09 | D08 | D07 | D06 | D05 | D04 | D03 | D02 | D01 | D00 | CLK |
|---|---|---|---|---|---|---|---|---|---|---|---|---|---|---|---|---|---|
| Data Row 1 | 0 | 0 | 0 | 0 | 0 | 0 | 0 | 0 | 0 | 0 | 0 | 0 | 1 | 0 | 0 | 0 | 1 |
| Data Row 2 | 0 | 0 | 0 | 0 | 0 | 0 | 0 | 0 | 0 | 0 | 0 | 0 | 0 | 0 | 0 | 0 | 0 |

FIG. 2B

| | Definition | Data Row 1 (Clock rising edge) | Data Row 2 (Clock falling edge) |
|---|---|---|---|
| 202 | D15 | 0 | 0 |
| | D14 | 0 | 0 |
| | D13 | 0 | 0 |
| | D12 | 0 | 0 |
| | D11 | 0=real address<br>1= imaginary address | 0 |
| 204 | D10-D00 | Row address data to be written | 0 |
| | CLK | 1 (clock rising edge) | 0 (clock falling edge) |

FIG. 2C 302 304

| | | DATA | CLOCK | | |
|---|---|---|---|---|---|
| Data Row | 1 | 00010000 00000000 | 1 | ; ts1 | Load address 0 |
| Data Row | 2 | 10011000 00000000 | 0 | ; ts1 | Load address 0 |
| Data Row | 3 | 00000000 00000000 | 1 | ; ts1 | column = 0 |
| Data Row | 4 | 11111111 11111111 | 0 | ; ts1 | column = 0 |

FIG. 3A 302 304

| | D15 | D14 | D13 | D12 | D11 | D10 | D09 | D08 | D07 | D06 | D05 | D04 | D03 | D02 | D01 | D00 | CLK |
|---|---|---|---|---|---|---|---|---|---|---|---|---|---|---|---|---|---|
| Data Row 1 | 0 | 0 | 0 | 0 | 0 | 0 | 0 | 0 | 0 | 0 | 0 | 0 | 1 | 0 | 0 | 0 | 1 |
| Data Row 2 | 1 | 0 | 0 | 0 | 0 | 0 | 0 | 0 | 0 | 0 | 0 | 1 | 1 | 0 | 0 | 0 | 0 |

FIG. 3B

| | Definition | Data Row 1 (Clock rising edge) | Data Row 2 (Clock falling edge) |
|---|---|---|---|
| 302 | D15 | 0 | 0 = no TWP, 1 = TWP present |
| | D14 | 0 | TWP row data value<br>0= low voltage<br>1= high voltage |
| | D13 | IBIST Flag<br>0= no IBIST<br>1= run IBIST | IBIST Flag<br>0= no IBIST<br>1= run IBIST |
| | D12 | Reserved(0) | Reserved(0) |
| | D11 | 0=real address<br>1= imaginary address | 0=real address<br>1= imaginary address |
| | D10-D00 | Row address data to be written | 0 |
| 304 | CLK | 1 (rising edge) | 0 (clock falling edge) |
| | | | |

FIG. 3C

MULTI-MODE PULSE WIDTH MODULATED DISPLAYS

RELATED APPLICATIONS

This application claims the benefit of U.S. provisional patent application Ser. No. 60/745,875, filed Apr. 28, 2006, entitled "Multi Mode Pulse Width Modulated Displays" which is hereby incorporated by reference in its entirety.

BACKGROUND

1. Field of the Invention

This invention relates generally to displays, and in particular to adjusting the duration of pulses for pulse width modulated displays.

2. Background

Pulse width modulated displays, in various forms, have been important products of the display industry for over 30 years. Originally the constant luminance displays were the primary type in use, although today both plasma display panels (PDP) and digital light processing (DLP) are the most common types found in wide distribution. U.S. Pat. No. 3,590,156, to Easton, provides an excellent early example of these types of displays.

Pulse width modulated displays are prone to a number of visual artifacts. The exact nature of each artifact depends heavily on the implementation of the pulse width modulation and the nature of the display in which it is implemented. These can be roughly divided into static image artifacts (gray scale errors) and motion artifacts (perception errors originating in the pulse width modulation). Pulse width modulated liquid crystal displays may also show a lateral field artifact which is present whether the image is moving or static and which has origins similar to those for moving artifacts.

One additional source of error in a pulse width modulated display is that it is often difficult to modulate the display with exactly the correct pulse width to achieve the desire gray level exactly. This limitation arises because of the limitations in the hardware implementation of the pulse width modulation concept.

A pulse width modulation technique in which the pulse width modulation is determined by the length of time a row is left in a given memory state is described in co-pending U.S. Patent Application, Publication No. US 2003/0210257, entitled "Modulation Scheme for Driving Digital Display Systems" incorporated by reference herein in its entirety. In the technique described, after a row of the display is written, the row is not visited again until a display data scheduling device writes the row again to establish a new data state for a different segment of the pulse width modulation. Each row can be addressed in turn as it is not necessary to change more than one row at a time.

FIG. 1A is a diagram illustrating an example of pulse width modulation. In FIG. 1A, a 1952×1112 element display is shown. The numeric coordinates represent position on the display with (0, 0) representing the upper left hand corner of the display. The coordinate system is arbitrary. The arrow 102 represent the direction of movement over time of the dividing line 104*a-d* between bit planes. The values of individual pixels are not presented here.

FIG. 1B is a diagram illustrating another example of pulse width modulation. In FIG. 1B, the lower left portion of a display is illustrated. The arrow 112 represent the direction of movement over time of the dividing line 114*a-e* between least significant bit planes.

The display as implemented sequences through each bit plane in an order determined by many factors, but principally by the need to control artifacts. The sequence is not explicitly important to this discussion. One important point is that each bit plane is written during a single sequence and then the sequence starts again on a different row.

Conceptually, the modulation method is relatively efficient of bandwidth. The use of regular row writes and the use of spacing to determine gray scale values facilitates the reduction, or elimination, of peaks and valleys in the required bandwidth without lowering system performance to an unacceptable level. In practice the surface area of a display presenting a particular higher order bit plane is roughly proportional to its weighting relative to the area displaying the least significant bit (LSB). The ratios are disturbed by the electro-optic curve of the liquid crystal cell but the principal is clear.

The modulation technique itself has a temporal coarseness or temporal resolution limitation in that the time for each bit plane can only be adjusted in one row increments. This limitation can be dealt with by such techniques as spatial and temporal dither, but these techniques add complexity to the calculation of the data to be displayed.

Therefore, there is a need for improved systems, apparatus, and techniques for providing a more deterministic method for modulating a display.

SUMMARY

The present invention includes methods, apparatuses, and systems as described in the written description and claims. In one example, improved techniques of modulating pulse width modulated displays are described.

In one embodiment, a method for providing a modulation drive sequence for a pulse width modulated display includes receiving a row write address. Then writing data to a specified row in a display on a first phase of a clock signal and terminating a write operation on a different row on a second phase of the clock signal.

In another embodiment, a display includes a processor that receives image data, such as gray scale level or multi color, commands and generates data to be written to rows of the display. The data includes a pulse width modulated drive sequence that writes data to selected rows on a first phase of a clock and terminates a write operation on a different row on a second phase of the clock. The display also includes a voltage controller that supplies at least one voltage supply that is used to drive the pixes to desired states.

In another embodiment, a control module for a pulse width modulated display includes a processor that receives image data, such as gray scale level or multi color, commands and generates data to be written to rows of the display. The data includes a pulse width modulated drive sequence that writes data to selected rows on a first phase of a clock and terminates a write operation on a different row on a second phase of the clock. The control module also includes a voltage controller that supplies at least one voltage supply that is used to drive the pixes to desired states.

In an embodiment, the first phase of the clock signal is a rising edge of the clock signal and the second phase of the clock signal is a falling edge of the clock signal. In addition, terminating a write operation comprises writing all elements in a row to a predetermined value. The predetermined value can correspond to a black level of the display, a white level of the display, a gray level of the display, or any desired level.

BRIEF DESCRIPTION OF THE DRAWINGS

The details of the present invention, both as to its structure and operation, may be gleaned in part by study of the accompanying drawings, in which like reference numerals refer to like parts.

FIG. 2A is a diagram illustrating an example of a data format.

FIG. 2B is a diagram illustrating further detail of the data and clock signal format.

FIG. 2C is a table that includes definitions for the various data bits and clock signal.

FIG. 3A is a diagram illustrating a data transfer format in which a "write to black" feature is implemented.

FIG. 3B is a diagram illustrating further detail of the data and clock signal format.

FIG. 3C is a table that includes definitions for the various data bits and clock signal.

DETAILED DESCRIPTION

Figure 1A:
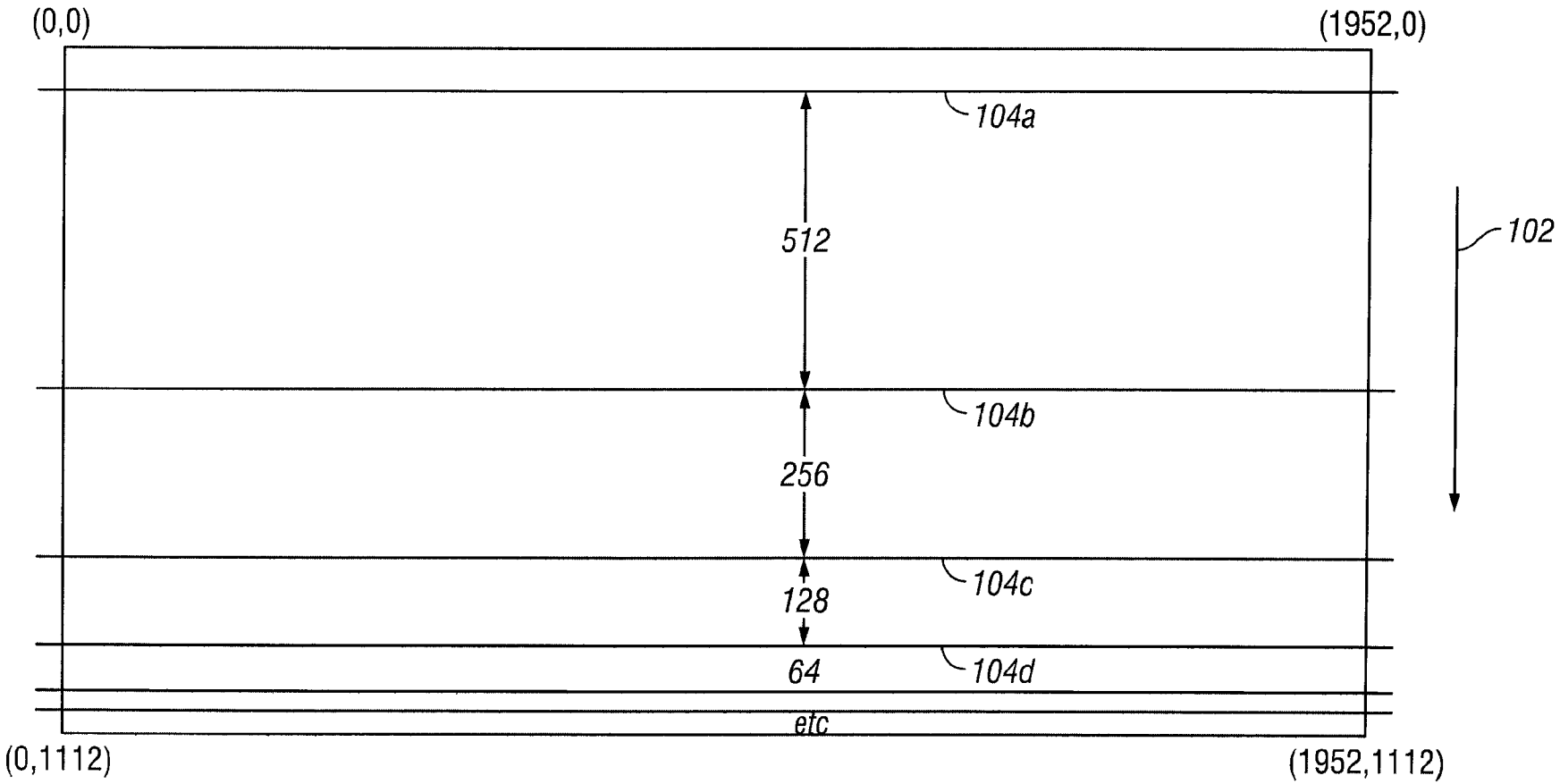
FIG. 1A is a diagram illustrating an example of pulse width modulation.
Figure 1B:
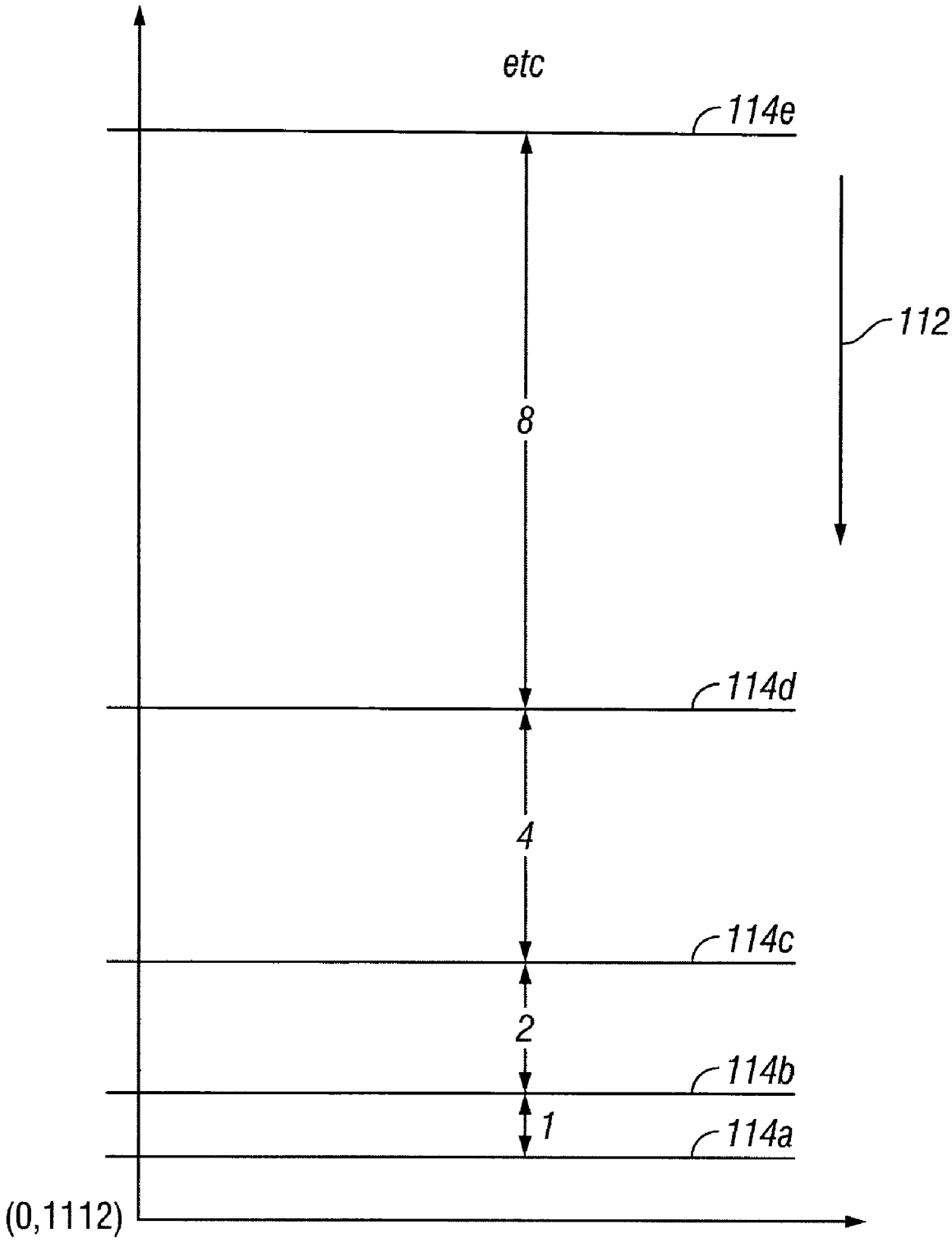
FIG. 1B is a diagram illustrating another example of pulse width modulation.

Certain embodiments as disclosed herein provide for methods and systems for techniques that provide improved modulation in pulse width modulated displays. After reading this description it will become apparent how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

In some types of displays, such as plasma displays or digital micro-mirror device displays, the modulation waveform and the resultant light output intensity are almost identical. In other types of displays, especially those based on nematic liquid crystals, the output light intensity may look like a smoothed version of the modulation waveform.

In one embodiment, techniques for providing improved, deterministic, adjustment of the pulse width modulation duration to a new duration that generates a brightness value that is closer to the desired value are described. The techniques can be broadly applied to pulse width modulation techniques, and are not limited to modulation of displays.

In one embodiment of modulating a display, the writing of data involves the transmission of information to the display that identifies the row to be written, and the data to be written on that row. The format of the data determines the action to be taken by the display with the information.

FIG. 2A is a diagram illustrating an example of a data format. In the example of FIG. 2A, the format includes a data bits 202 and a clock signal 204. FIG. 2B is a diagram illustrating further detail of the data and clock signal format. As shown in FIG. 2B, the data 202 includes sixteen bits (D00-D15) and a one bit clock signal 204. FIG. 2C is a table that includes definitions for the various data bits 202 and clock signal 204.

In the example of FIGS. 2A-C, data on the rising edge of the clock signal, indicated by a clock value of one, includes a flag (not shown) to indicate that the data is address data and not image data, as well as the actual address data, bits D00-D10. The data, bits D12-D15, on the rising edge are set to zero across, as this is not used in this particular implementation. The address and data, bits D00-D15, are all set to zero on the following edge of the clock signal because there is no operation on the following edge of the clock signal.

The example of FIGS. 2A-C illustrate a bus width of 16 bits. However, the choice of bus width is arbitrary. Common data bus widths are 16 bit and 32 bit although 24 bit has also been used.

In another embodiment, an interface to a micro-display uses dual phase data transfer where data can be written on both the rising and falling edges of the clock signal. A technique of using both rising and falling edges of a clock signal in memory interfaces is described in "R3000/R3001 Designers Guide" published by Integrated Device Technology (IDT) in 1990, incorporated herein in its entirety. While dual phase data transfer has been implemented in other technologies, the advantages of dual phase data transfer in pulse width modulated systems has not been recognized before.

FIG. 3A is a diagram illustrating a data transfer format in which a "write to black" feature is implemented. In the example of FIG. 3A, the format includes a data bits 302 and a clock signal 304. FIG. 3B is a diagram illustrating further detail of the data and clock signal format. As shown in FIG. 3B, the data 302 includes sixteen bits (D00-D15) and a one bit clock signal 304. FIG. 3C is a table that includes definitions for the various data bits 302 and clock signal 304.

In the example of FIGS. 3A-C, using dual phase data transfer, the second phase of the row address block is used to identify that a row is to be set to a single value, the address of the row, and the value to be set into that row. This embodiment offers many advantages over previous techniques. For example, because the second phase of the clock signal, i.e. the falling edge, was not previously used, this is an extremely efficient means of implementing this feature. In alternative embodiments, one extra data transfer may be needed, but that is still extremely efficient compared to requiring a row be written bit at a time.

Returning to FIG. 3C, data bits D00-D10 include the row address to be written on the clocks rising edge, and the row address to be terminated on the clocks falling edge. The address of the row to be terminated is also referred to as a terminated write pointer (TWP).

Data bit D11 indicates if the row address is real or imaginary. Identifying an imaginary row address permits the transmission of TWP data to the microdisplay in an instance where the corresponding row write is "off the screen." In some instances write pointers may not be on the physical screen but rather a virtual one. This can occur when the number of rows is smaller than the number of bits of data. For example, 10 bits of data equals 1024 individual settings whereas an HDTV display after SMPTE 296 will have 720 physical rows. Using the row spacing logic to determine timing results requires the addition of virtual rows to be fully functional. One technique to simplify circuit design is to transfer data that is deferred by the device, because not transmitting data can require additional circuitry. The second phase of the row address can still be real and write a second row to a desired black. There is also a logic to writing a virtual row to black because this can simplify the logic of gray scale generation.

In the embodiment of FIGS. 3A-C data bit D12 is reserved, and can be used for other purposes. Data bit D13 is used to indicate if an improved built-in self test (IBIST) should be run. In this embodiment, if data bit D13 is set to a one the IBIST is run, and if data it D13 is set to zero the IBIST is not run. Data bit 15 indicates if a TWP is present, data bit 15 set to one, or if there is no TWP present, D15 set to zero. Data bit 14 is used to provide the ability to chose whether the "write to black" action will write a high voltage or a low voltage. In a normally black liquid crystal mode a low voltage corresponds to a dark state, while a normally white liquid crystal mode a high voltage corresponds to a dark state. Use of a bit to indicate the voltage level to write to provides added flexibility. While many current commercial modes are normally black the addition of this features allows both modes to be supported.

Figure 4:
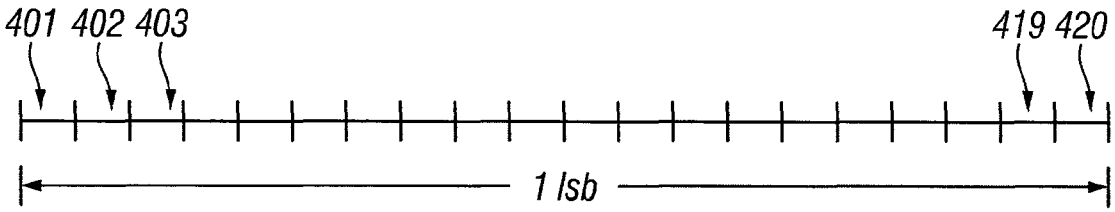
FIG. 4 is a diagram illustrating a simple time line for the write pointer actions during a single least significant bit (LSB) time.

FIG. 4 is a diagram illustrating a simple time line for the write pointer actions during a single least significant bit (LSB) time. In the example illustrated in FIG. 4, once a single LSB row is written, twenty additional rows are written, indicated by 401-420, before the sequence returns to rewrite the individual row. An advantage to using the write to black feature, is that an individual row can be written to black, or terminated, on the falling edge of any of the write pointers during the LSB frame. Using this technique, a resolution of 1/20 of an LSB can be achieved for the timing of the terminated row. In other words, instead of having to wait for an entire LSB period before being able to terminate a row, a row can now be terminated in $1/20^{th}$ of an LSB period. Because only one row can be written at a time, the application of this fine tuning of row time is not completely arbitrary but it does afford substantial flexibility.

Figure 5A:
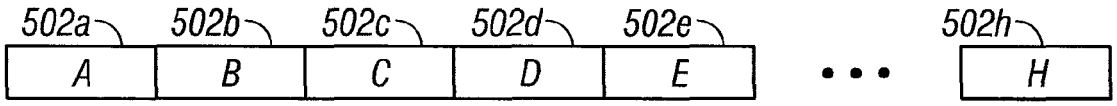
FIG. 5A is a diagram illustrating an example modulation drive sequence.

FIG. 5A is a diagram illustrating an example modulation drive sequence. The drive sequence includes multiple temporal segments that can be used to activate, or turn on, or deactivate, or turn off, a display element. In FIG. 5, segments 502*a*-502*d* are turned on, and segments 502*e*-502*e* are turned off. In FIG. 5A, the individual modulation segments 502*a-h* show are equally weighted although they can be differently weighted.

Figure 5B:
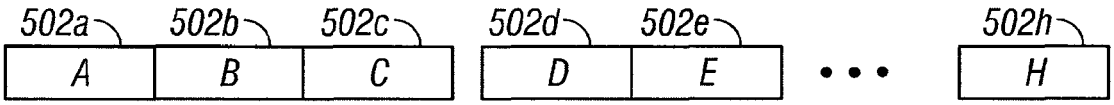
FIG. 5B is a diagram illustrating the modulation drive sequence of FIG. 5A with one of the segments of the drive sequence terminated.

FIG. 5B is a diagram illustrating the modulation drive sequence of FIG. 5A with one of the segments of the drive sequence terminated. In FIG. 5B, segments 502*a*-502*d* are turned on and segments 502*e-h* are turned off. Segment 502*c*' is terminated early using the write to black techniques described. Because segment 502*c*' in FIG. 5B is terminated earlier that segment 502*c* in FIG. 5*a*, the total modulation on time for the sequence of FIG. 5B will be less that the sequence of FIG. 5A. The ability to terminate a segment early represents a substantial improvement in the ability to set gray scale accurately.

Figure 6A:
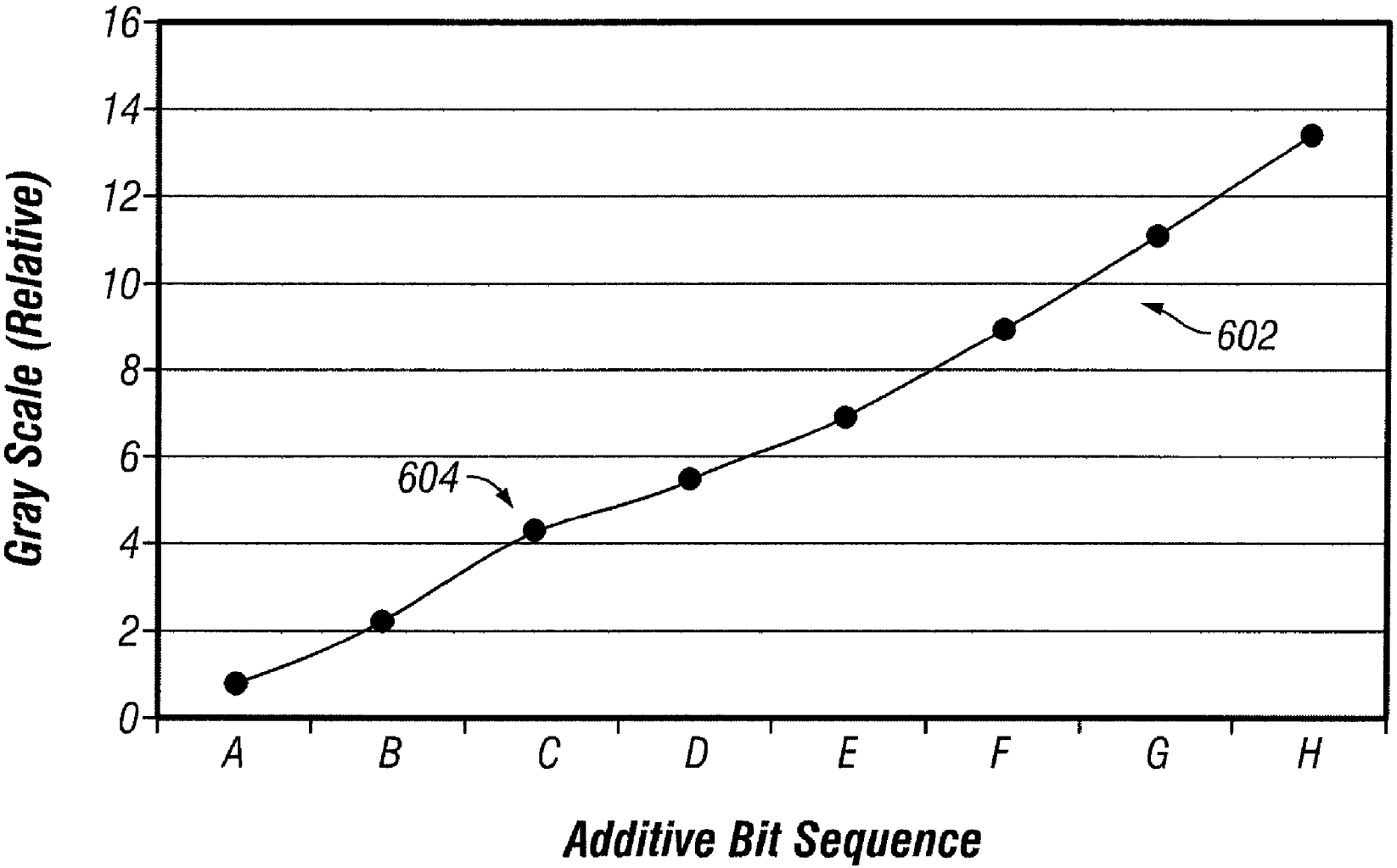
FIG. 6A is a chart illustrating the relative intensity curve of additive segments of the modulation sequence of FIG. 5A.

FIG. 6A is a chart illustrating the relative intensity curve 602 of additive segments of the modulation sequence of FIG. 5A. In the example of FIG. 6A, the relative intensity curve 602 has a "bump" 604 resulting from the addition of segment 502*c*. This bump in the intensity curve can be due to the transfer characteristics of the display device, or other reason. In the example of FIG. 6A, the resulting intensity bump due to segment 502*c* results in a nonlinearity in the displayed images.

Figure 6B:
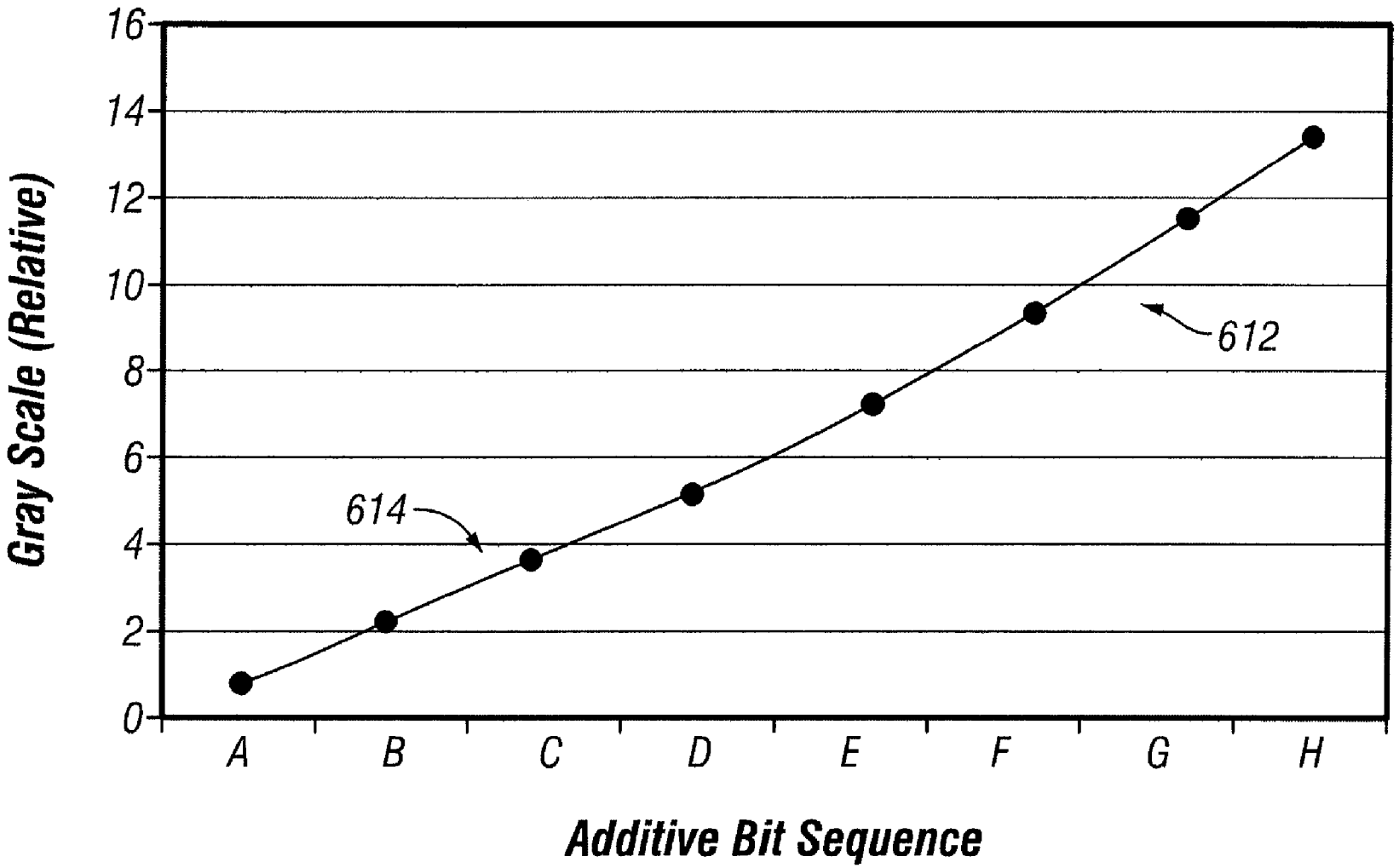
FIG. 6B is a chart illustrating the relative intensity curve of additive segments of the modulation sequence of FIG. 5B.

FIG. 6B is a chart illustrating the relative intensity curve 612 of additive segments of the modulation sequence of FIG. 5B. In the example of FIG. 6B, the relative intensity curve 612 is smooth, and the "bump" 604 caused by the addition of segment 502*c* illustrated in FIG. 6A is reduced, or eliminated. Because segment 502*c*' was terminated early using the write to black methodology previously described, segment 502*c*' has slightly less modulation on time than segment 502*c* in FIG. 5A.

There are many advantages to being able to terminate individual bit planes early. For example, there can be a substantial improvement in the ability to set gray scale accurately. In addition, by terminating modulation sequence segments early the relative intensity response of a device can be smoothed.

While the above describes a write to black technique, in a similar manner a rite to white technique can be implemented. In a write to white technique, a segment that is turned on could have its on time extended by writing to white before the start of the segment, or writing to white at the end of the segment. Likewise, write to white and write to black techniques can be intermixed in the same system.

Figure 7:
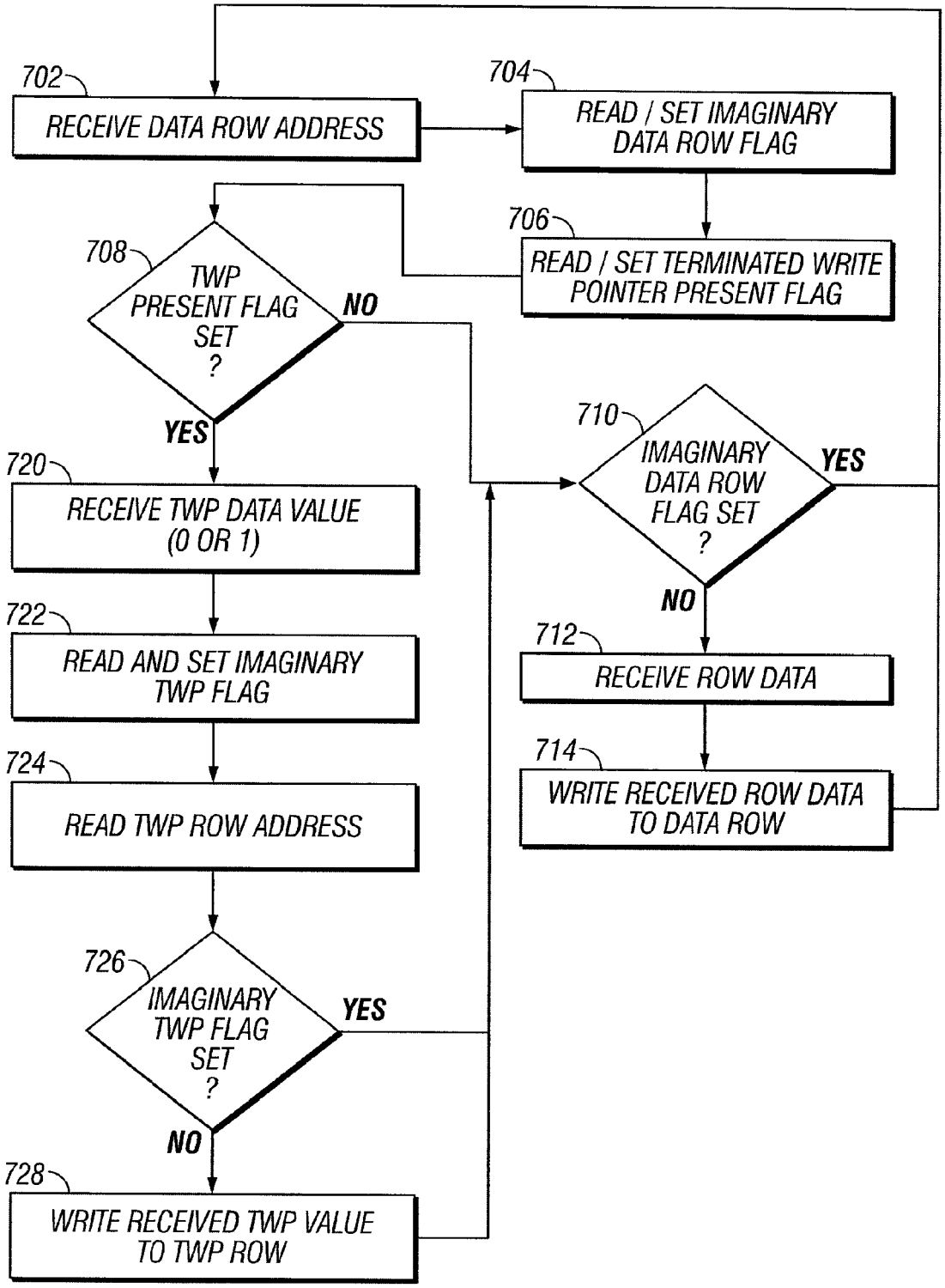
FIG. 7 is a flow chart of an embodiment of modulating a pulse width modulated display.

FIG. 7 is a flow chart of an embodiment of modulating a pulse width modulated display. Flow begins in block 702 where row address data is received. Flow continues to block 704 where an imaginary data row flag is read. Flow then continues to block 706 where a terminated write pointer (TWP) flag is read. Flow then continues to block 708.

In block 708 it is determined if the terminated write pointed (TWP) flag is set. If the TWP flag is set, then the TWP value is written to the TWP row as indicated in blocks 720 through 728 explained in further detail below. If the TWP flag is not set, then the system proceeds with the processing of writing data as described in blocks 710 through 714 explained further below.

In block 708, if it is determined that the terminated write pointer flag is set flow continues to block 720 where a terminated write pointer data value is received. The terminated write pointer data value indicates a value for the data that will be written to the terminated row. In one embodiment, the terminated write pointer data value is a single bit, and thus is one of two states and can, for example, drive to black, or drive to white. In another embodiment, the terminated write pointer data value can be more than one bit, and can drive to any other desired value. Flow then continues to block 724 where the address of the row to be terminated is read.

Flow continues to block 726 where the value of the imaginary data flag in the received data is determined, indicating if the data row is on or off display. If the imaginary data row flag is set, indicating that the row is off the display, then flow continues to block 710 where it is determined if the imaginary data row flag is set.

If, in block 726 if it is determined that the imaginary data row flag is not set, then flow continues to block 728. In block 728, the terminated write pointer data value is written to the row addressed in the terminated write pointer operation. Flow then continues to block 710.

In one embodiment, imaginary data rows and imaginary TWP rows are present so that the process can be "stalled" to insure that the time to accommodate an imaginary row is the same as the time to accommodate a real one. This insures that the timing integrity is maintained.

Returning to block 708, if it is determined that the terminated write pointer flag is not set flow continues to block 710. In block 710 the value of the imaginary data row flag is determined, indicating whether the data row is on or off the display. If it is determined that the imaginary data row flag is set, indicating that the row is off display, then flow continues to block 702 and the next data row address is received.

If, in block 710 it is determined that the imaginary data row flag is not set, indicating that the row is on the display, then flow continues to block 712. In block 712 the row data is received. Flow then continues to block 714 and the received row data is written to the row addressed. Flow then continues to block 702 and another data row address is received.

Figure 8:
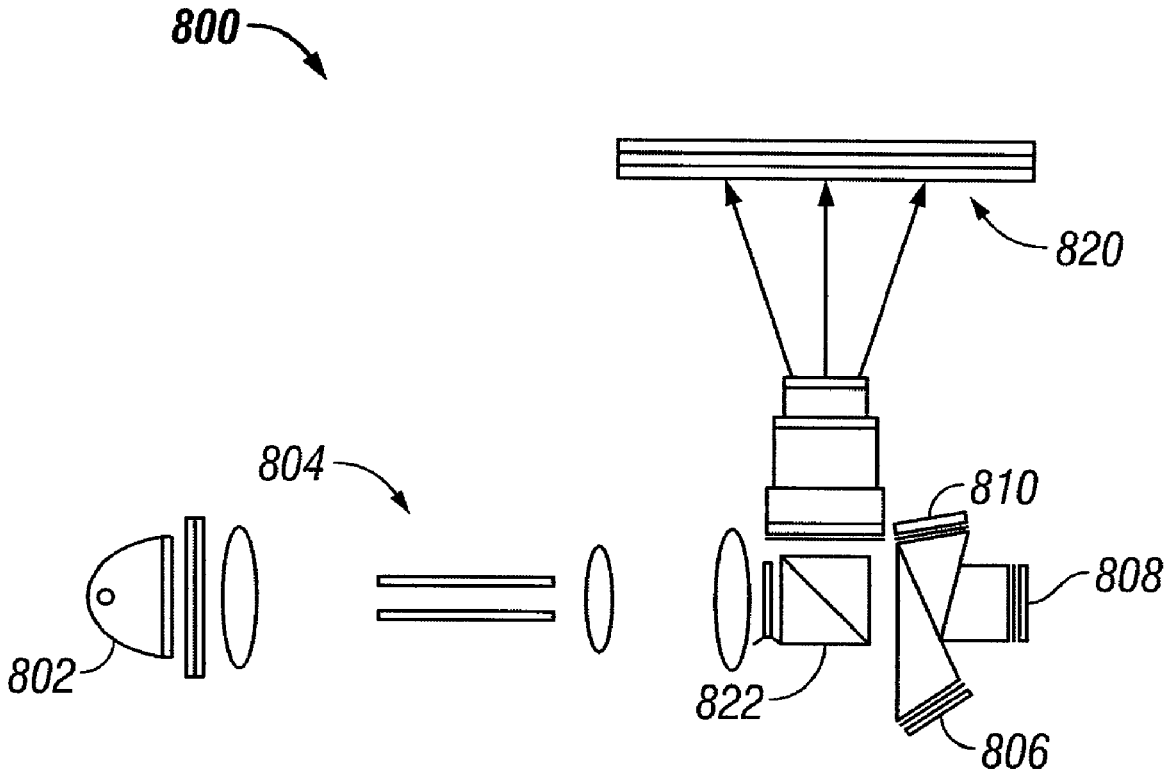
FIG. 8 is a block diagram of a display system that can use aspects of the improved modulation techniques as disclosed herein.

FIG. 8 is a schematic diagram of a display system that can use aspects of the improved modulation techniques as disclosed herein. The display system 800 using improved modulation techniques described herein may be used for projecting an image. A white light source 802 and optics 804 may be used to direct light toward a polarizing beam splitter/Philips prism combination 822 that separates the white light into red, green, and blue components. The red, green, and blue components are directed towards displays 810, 808, and 806. A controller, not shown, can generate drive sequences, as described above, to drive the displays 806, 808, and 810 so that each display creates a gray scale image of one color which is then combined through the polarizing beam splitter/Philips prism combination 822 and projected through a projection lens to form the image 820. The displays according to the present invention may also be used in other multi-display devices as known in the art.

Figure 9:
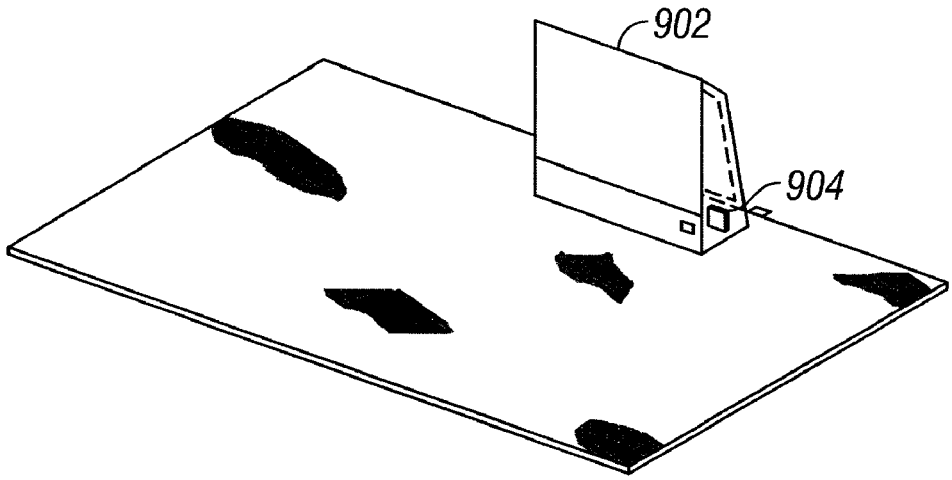
FIG. 9 is a block diagram of an embodiment of a television or monitor incorporating a display that includes a controller that generates modulation drive sequences.
Figure 10:
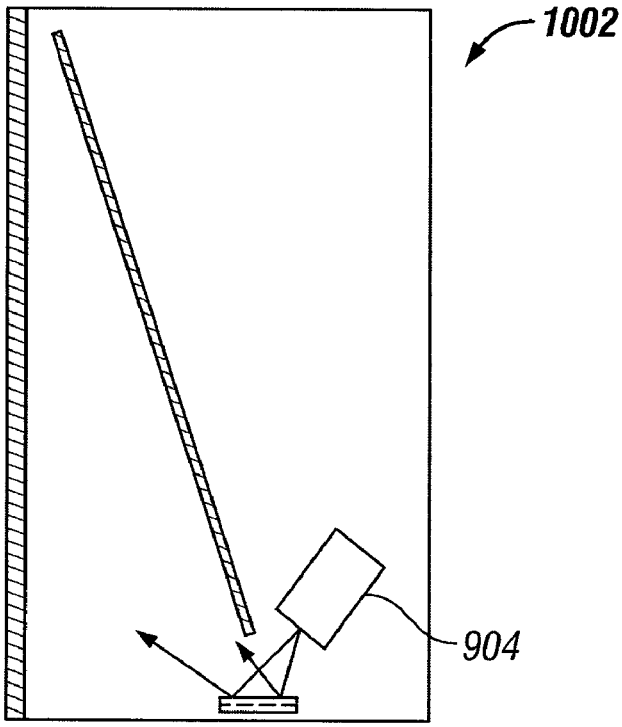
FIG. 10 is a block diagram of another embodiment of the television or monitor as a rear projection device.
Figure 11:
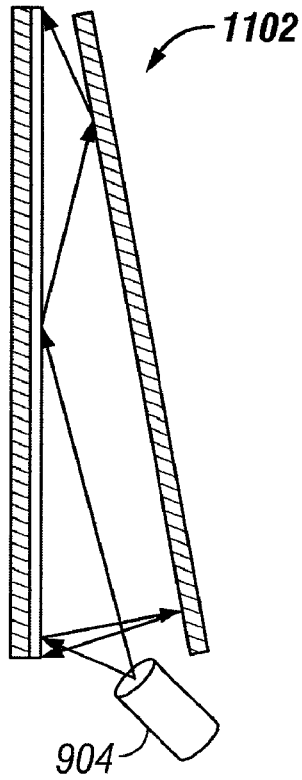
FIG. 11 is a block diagram of another embodiment of the television or monitor as a rear projection device.

Modulation techniques as described herein can be used in various display systems. FIG. 9 is a block diagram of an embodiment of a television or monitor 902 incorporating a display 904 that includes a controller that generates modulation drive sequences as described herein, for example, drive sequences as described in FIGS. 3-7. The modulation drive sequences are used to generate gray scale used in generating the image displayed. FIG. 9 is a block diagram illustrating an embodiment of the television or monitor 902 as a rear projection device. FIG. 10 is a block diagram of another embodiment of the television or monitor 1002 as a rear projection device. FIG. 11 is a block diagram of another embodiment of the television or monitor 1102 as a rear projection device. Various configurations may be used to project a larger image from display device 1104. For example, a front projection device (not shown) similar to that shown in FIG. 8, may also be used to create a larger image from a display device 9.

Figure 12:
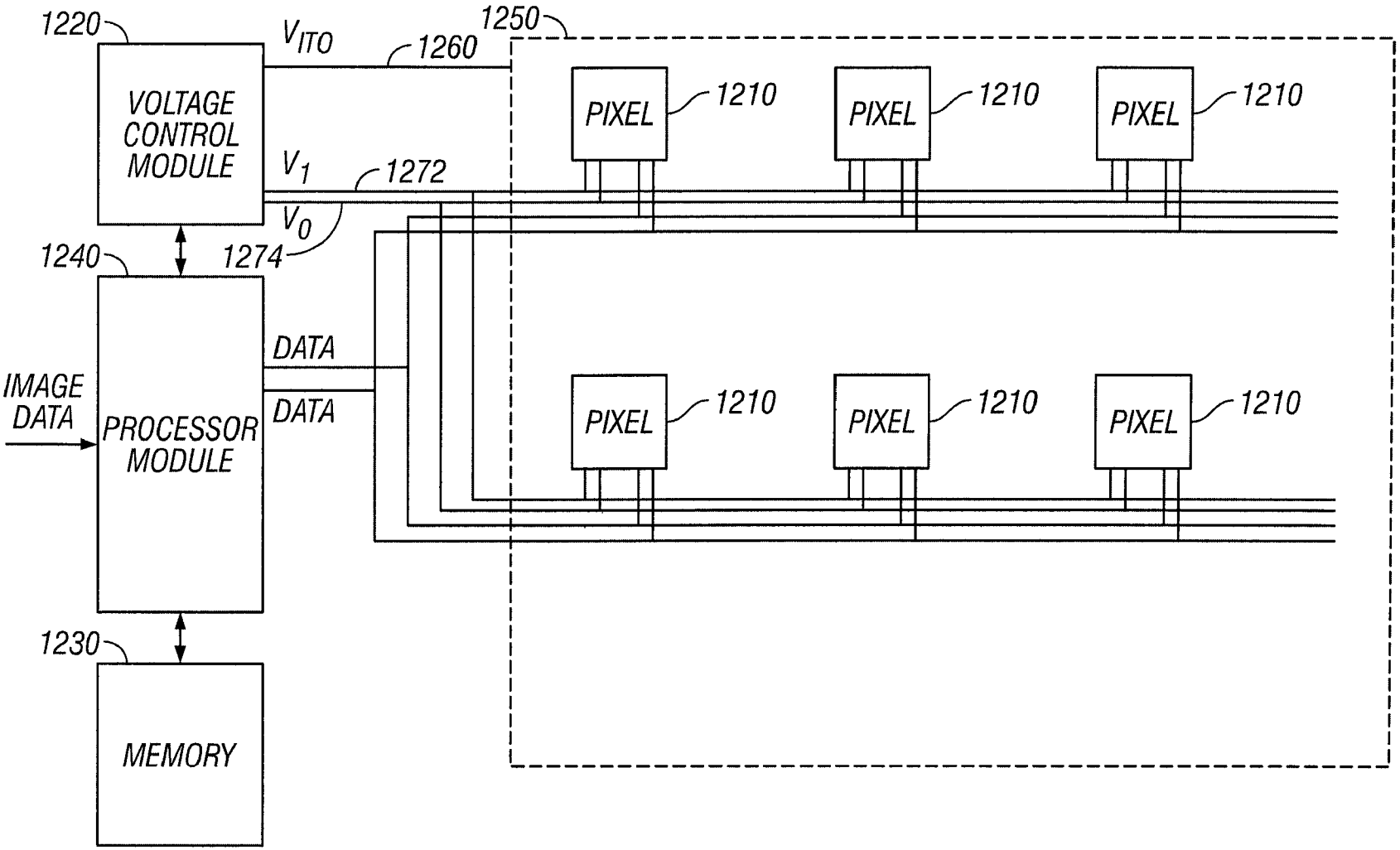
FIG. 12 is a block diagram of one embodiment of a display system 1200.

FIG. 12 is a block diagram of one embodiment of a display system 1200. The display system 1200 includes an array of pixel cells 1210, a voltage control module 1220, a processing module 1240, a memory module 1230, and a transparent common electrode 1250. The common transparent electrode overlays the entire array of pixel cells 1210. In one embodiment, pixel cells 1210 are formed on a silicon substrate or base material, and are overlaid with an array of pixel mirrors and each single pixel mirror corresponding to each of the pixel cells 1210. A substantially uniform layer of liquid crystal material is located in between the array of pixel mirrors and the transparent common electrode 1250. The transparent common electrode 1250 is a conductive glass material such as Indium Tin-Oxide (ITO). In another embodiment, the transport electrode 1250 is coated onto a glass material. Both the glass side and the silicon side are coated with an alignment layer, for example, $SiO_2$ or other material.

In one embodiment, the processor module 1240 receives data from an image source. The source data may be in various formats such as digital video interface (DVI), or high definition multimedia interface (HDMI), or other format. The source data can also represent a single color, or multiple colors within an image. The processor module 1240 is in communication with a voltage control module 1220 and a memory module 1230.

The memory module 1230 is a computer readable medium including programmed data and commands. The memory module can also buffer source data or processed data from the processor module 1240. In one embodiment, the memory module 1230 may store data and the processor module 1240 may also include registers to store data.

The voltage control module supplies the bias voltage Vito 1260 to the common transparent electrode 1250. The voltage control module 1220 also supplies the voltages V0 and V1 (1272 and 1274) that are used to drive the pixels 1210. As is well know in the art, Vito may be a single preset voltage or it may be two or more time sequenced alternating voltages, depending on the precise display architecture used.

The processing module 1240 can produce modulation schemes for controlling the gray scale of the pixels cells 1210. In one embodiment, the processing module 1240 generates modulation drive sequences, such as the modulation drive sequences describe in relation to FIGS. 3-7, and provides data 1280 and compliment of the data 1282 to the pixels 1210 to select the voltage level that is applied to the pixel in accordance with the drive sequence. In one embodiment, a separate signal is sent by the processing module 1240 to a voltage selection circuit to set the state of a DC balance control element that can either pass the data signal state as is or else invert it. Alternatively, the supply voltages V0 and V1 may be alternated to create a similar effect at the pixel.

In one embodiment, the functions of the processing module 1240, memory 1230 and voltage control module 1220 are performed in a single module or device. In other embodiments, the functions are distributed across multiple modules or devices.

The techniques described herein may be implemented by various means. For example, these techniques may be implemented in hardware, firmware, software, or a combination thereof. A hardware implementation may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, electronic devices, other electronic units designed to perform the functions described herein, or a combination thereof.

For a firmware and/or software implementation, the techniques may be implemented with modules (e.g., procedures, functions, and so on) that perform the functions described herein. The software codes may be stored in a memory (e.g., memory module 1230 in FIG. 12) and executed by a processor (e.g., processor module 1240 in FIG. 12). The memory may be implemented within the processor module or external to the processor.

The term "module" as used herein means, but is not limited to a software or hardware component, such as an FPGA or an ASIC, which performs certain tasks. A module may advantageously be configured to reside on an addressable storage medium and configured to execute on one or more network enabled devices or processors. Thus, a module may include, by way of example, components, processes, functions, attributes, procedures, subroutines, segments of program code, drivers, firmware, microcode, circuitry, data, databases, data structures, tables, arrays, variables, and the like. The functionality provided for in the components and modules may be combined into fewer components and modules or further separated into additional components and modules. Additionally, the components and modules may advantageously be implemented to execute on one or more network enabled devices or computers.

Furthermore, those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

The above description of the disclosed implementations is provided to enable any person skilled in the art to make or use the invention. Various modifications to these implementations will be readily apparent to those skilled in the art, and the generic principles described herein can be applied to other implementations without departing from the spirit or scope of the invention. Thus, it is to be understood that the description and drawings presented herein represent example implementations of the invention and are therefore representative of the subject matter which is broadly contemplated by the present invention. It is further understood that the scope of the present invention fully encompasses other implementations and that the scope of the present invention is accordingly limited by nothing other than the appended claims.

What is claimed is:

1. A projection display system comprising:

an illumination source with optics to direct that illumination to a display component;

projection optics to direct light from a display component to a display screen; and a display component system comprising a display component and display controller, wherein the display component is modulated by data from the display controller, said data comprising a pulse width modulated drive sequence that writes data to a selected row and terminates a write operation on a different row; wherein the terminating write operation comprises writing all elements in a row to a single predetermined value, thereby terminating the duration of the pulse width modulation on that row by a deterministic time comprising at least a fraction of a least significant bit.

2. The projection display system of claim 1, wherein the predetermined value corresponds to a black level of the display.

3. The projection display system of claim 1, wherein the pixels comprise liquid crystal on silicon elements.

4. The projection display system of claim 1, wherein the display component is a nematic liquid crystal display.

5. A controller for a pulse width modulated display, the controller comprising:

a voltage controller that provides at least one voltage supply that is applied to pixels in a display; and a processor that receives image data and generates data to be written to rows of pixels in the display, wherein the data to be delivered comprises a pulse width modulated drive sequence that writes data to a selected row and terminates a write operation on a different row; wherein the terminating write operation comprises writing all elements in a row to a single predetermined value, thereby terminating the duration of the pulse width modulation on that row by a deterministic time comprising at least a fraction of a least significant bit.

6. The controller of claim 5, wherein the predetermined value corresponds to a black level of the display.

7. The controller of claim 5, wherein the predetermined value corresponds to a white level of the display.

8. The controller of claim 5, wherein the image data comprises a gray scale command.

9. The controller of claim 5, wherein the image data comprises multiple color image data.

10. The controller of claim 5, wherein the pulse width modulated display is a nematic liquid crystal display.

11. The controller of claim 5, wherein the data received by the controller is digital image data.

12. A method for providing a modulation drive sequence for a pulse width modulated display, the method comprising:

receiving a row write address;

receiving a second row write address and a terminating value to be written to the second row;

writing data to an addressed row in a display; and terminating a write operation on the second row; wherein the terminating write operation comprises writing all elements in a row to a single predetermined value, thereby terminating the duration of the pulse width modulation on that row by a deterministic time comprising at least a fraction of a least significant bit.

13. The method of claim 12, wherein the predetermined value corresponds to a black level of the display.

14. The method of claim 12, wherein the predetermined value corresponds to a white level of the display.

15. The method of claim 12, wherein writing data to the addressed row comprises applying pulse width modulated signals to pixels in the row.

16. The method of claim 12, wherein the data address is received on one clock phase and the data address for the terminating write operation is received on a subsequent clock phase.

17. The method of claim 16, wherein the first clock phase is a rising edge of a clock cycle and the subsequent clock phase is a falling edge of a clock cycle.

18. The method of claim 12, wherein the pulse width modulated display is a nematic liquid crystal display.

19. A display comprising:

an array of pixel elements;

a voltage controller that provides at least one voltage supply that is applied to the pixels in the display; and a processor that receives image data and generates data to be written to rows of pixels in the display, wherein the data comprises a pulse width modulated drive sequence that writes data to a selected row and terminates a write operation on a different row; wherein the terminating write operation comprises writing all elements in that row to a single predetermined value, thereby terminating the duration of the pulse width modulation on that row by a deterministic time comprising at least a fraction of a least significant bit.

20. The display of claim 19, wherein the predetermined value corresponds to a black level of the display.

21. The display of claim 19, wherein the predetermined value corresponds to a white level of the display.

22. The display of claim 19, wherein the pixels comprise liquid crystal on silicon elements.

23. The display of claim 19, wherein the image data comprises a gray scale command.

24. The display of claim 19, wherein the image data comprises multiple color image data.

25. The display of claim 19, wherein said display is a nematic liquid crystal display.

* * * * *

UNITED STATES PATENT AND TRADEMARK OFFICE

CERTIFICATE OF CORRECTION

PATENT NO. : 7,852,307 B2
APPLICATION NO. : 11/740244
DATED : December 14, 2010
INVENTOR(S) : Hudson It is certified that error appears in the above-identified patent and that said Letters Patent is hereby corrected as shown below:

In the Drawings

Sheet 6, FIG. 3C, should be replaced with FIG. 3C below.

| | Definition | Data Row 1 (Clock rising edge) | Data Row 2 (Clock falling edge) |
|---|---|---|---|
| 302 | D15 | 0 | 0 = no TWP, 1 = TWP present |
| | D14 | 0 | TWP row data value<br>0= low voltage<br>1= high voltage |
| | D13 | IBIST Flag<br>0= no IBIST<br>1= run IBIST | IBIST Flag<br>0= no IBIST<br>1= run IBIST |
| | D12 | Reserved(0) | Reserved(0) |
| | D11 | 0=real address<br>1= imaginary address | 0=real address<br>1= imaginary address |
| | D10-D00 | Row address data to be written | Row address of TWP |
| 304 | CLK | 1 (rising edge) | 0 (clock falling edge) |
| | | | |

FIG. 3C

Signed and Sealed this
First Day of October, 2013

Teresa Stanek Rea

Teresa Stanek Rea
*Deputy Director of the United States Patent and Trademark Office*